United States Patent [19]

Schepp

[11] Patent Number: 4,576,330

[45] Date of Patent: Mar. 18, 1986

[54] FOOD TRAY WITH LOCKABLE LID

[75] Inventor: Frank Schepp, Milford, Conn.

[73] Assignee: Inline Plastics Corporation, Milford, Conn.

[21] Appl. No.: 710,398

[22] Filed: Mar. 11, 1985

[51] Int. Cl.[4] ..... B65D 1/34

[52] U.S. Cl. ..... 229/44 R; D9/423; D9/425; 24/702; 229/2.5 R; 229/45 R

[58] Field of Search ..... 229/2.5 R, 30, 2.5 EC, 229/44 R, 44 EC, 45 R, 45 EC; 220/339; D7/76; 24/588, 598, 599, 600, 601, 629, 683, 700, 701, 702; D9/420, 423, 424–426, 431, 432

[56] References Cited

U.S. PATENT DOCUMENTS

| | | | |
|---|---|---|---|
| D. 276,590 | 12/1984 | Lobel | D9/426 |
| 3,164,478 | 1/1965 | Bostrom | 229/45 R |
| 3,421,682 | 1/1969 | Eisenbach | 229/44 EC |
| 3,447,731 | 6/1969 | Lehman | 229/44 EC |
| 3,552,595 | 1/1971 | Gerner | 229/2.5 R |
| 3,596,822 | 8/1971 | Holley | 229/44 R |
| 3,633,785 | 1/1972 | Cyr | 220/339 |
| 3,669,606 | 6/1972 | Brown | 229/44 EC |
| 3,786,982 | 1/1974 | Rakes et al. | 229/45 R |
| 3,807,622 | 4/1974 | Belcher et al. | 229/2.5 R |
| 3,933,296 | 1/1976 | Ruskin et al. | 229/2.5 R |
| 3,937,389 | 2/1976 | Wind | 220/339 |
| 4,057,169 | 11/1977 | Payne | 229/2.5 R |
| 4,197,940 | 4/1980 | DeRossett | 229/2.5 R |
| 4,243,140 | 1/1981 | Thrun | 229/2.5 R |
| 4,494,650 | 1/1985 | Cullen | 229/2.5 R |

FOREIGN PATENT DOCUMENTS

| | | | |
|---|---|---|---|
| 209114 | 5/1960 | Austria | 24/702 |
| 1117491 | 2/1982 | Canada | 229/44 R |
| 1580011 | 7/1969 | France | 229/2.5 R |
| 2456495 | 1/1981 | France | 220/339 |
| 1418897 | 12/1975 | United Kingdom | 229/45 EC |

*Primary Examiner*—William Price
*Assistant Examiner*—Gary E. Elkins
*Attorney, Agent, or Firm*—Barry Kramer; Frederick H. Rabin

[57] ABSTRACT

The present invention embodies an upright cylindrical element or peg on the horizontal flange of a tray which is received in snap, reversible locking engagement within the closed bore of a cylindrical female element provided in a corresponding location on the horizontal flange on a lid so that the lid and tray can be firmly and securely locked together. The male and female elements are formed during the thermoforming process used to form the lid and tray wherein the peg or male snap part is provided with an enlarged diameter portion at its closed top end or head which is received in snap engagement past a smaller diameter annular rim formed in the opening to the bore of the female cylindrical element. The female element also includes a side wall which is tapered from bottom to top for receiving the head of the peg or mating cylindrical male element which snaps over and past the annular rim. The head of the peg is guided by the tapered side wall into secure engagement with the interior end surface of the bore of the female element.

8 Claims, 8 Drawing Figures

FOOD TRAY WITH LOCKABLE LID

FIELD OF THE INVENTION

This invention relates to a food package or container, and more particularly, a thermoformed plastic tray provided with a hinged lid or cover which is lockable to the tray.

DESCRIPTION OF THE PRIOR ART

Food has heretofore been sold, particularly in carry-out, fast-food restaurants, in packages consisting of a tray provided with a hinged lid. The tray is usually thermoformed from clear plastic material or thermally insulated material such as Styrofoam designed to maintain the food housed within the tray, warm. The lid includes a flange which has been heretofore seated in snap engagement with a horizontal flange integrally molded about the rim portion of the food-carrying tray. Attempts to hold the lid in closed position on the flange about the rim portion of the tray have generally heretofore proved unsuccessful.

Such attempts have taken the form of providing an upstanding or vertical wall about the perimeter or periphery of the horizontal flange on the rim portion of the tray wherein the distance between opposed portions of the upstanding wall has been slightly less than the distance between corresponding portions of the mating flange on the lid so that the flange on the lid is engaged between opposed portions of the vertical wall on the perimeter of the horizontal tray flange in tight, snap engagement. Because of the resiliency inherent in the hinge attaching the lid to the tray, the lid has not been held in place in snap engagement between opposite portions of the vertical wall. Further, because of the materials used to form the tray, the distances between opposite portions of the upstanding wall and corresponding portions of the horizontal flange on the lid have been imprecise, therefore failing to effect snap engagement of the lid between opposite portions of the upstanding wall.

In an attempt to cure this deficiency, it has been proposed to form mating male and female cylindrical elements on the horizontal flanges of the lid and tray, respectively, in order to lock the lid to the tray. Once again, due to the imprecise formation of the diameter of the cylindrical mating elements and the inherent resiliency in the hinge of the lid, the attempt to provide such a lockable lid in a food tray provided with a lid has proven unsatisfactory. The female cylindrical element receiving the mating cylindrical male element has usually been of a greater diameter whereby the locking effect is negated, or the female element receiving the male element has been of a smaller diameter wherein the male element cannot be placed within the bore of the female element to lock the lid to the tray.

SUMMARY OF THE INVENTION

The present invention cures the deficiencies noted in connection with the prior art hinge-lidded, food trays by providing an upright cylindrical element or peg on the horizontal flange of the tray which is received in snap, reversible locking engagement within the closed bore of a cylindrical female element provided in a corresponding location on the horizontal flange on the lid so that the lid and tray can be firmly and securely locked together. The male and female elements are formed during the thermoforming process used to form the lid and tray wherein the peg or male snap part is provided with an enlarged diameter portion at its closed top end or head which is received in snap engagement past a smaller diameter annular rim formed in the opening to the bore of the female cylindrical element. The female element also includes a side wall which is tapered from bottom to top for receiving the head of the peg or mating cylindrical male element which snaps over and past the annular rim. The head of the peg is guided by the tapered side wall into secure engagement with the interior end surface of the bore of the female element.

BRIEF DESCRIPTION OF THE DRAWING

Further objects and advantages of the present invention will become more apparent from the following description and claims, and from the accompanying drawing, wherein:

DETAILED DESCRIPTION OF THE PREFERRED EMBODIMENT

Figure 1:
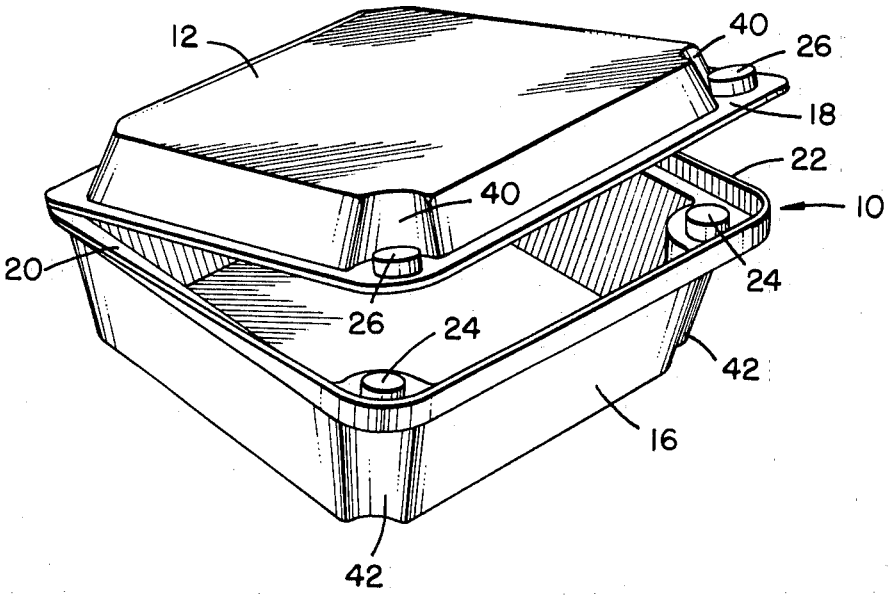
FIG. 1 is a perspective view of one form of the food tray of the present invention which is provided with a lockable, hinged lid.
Figure 2:
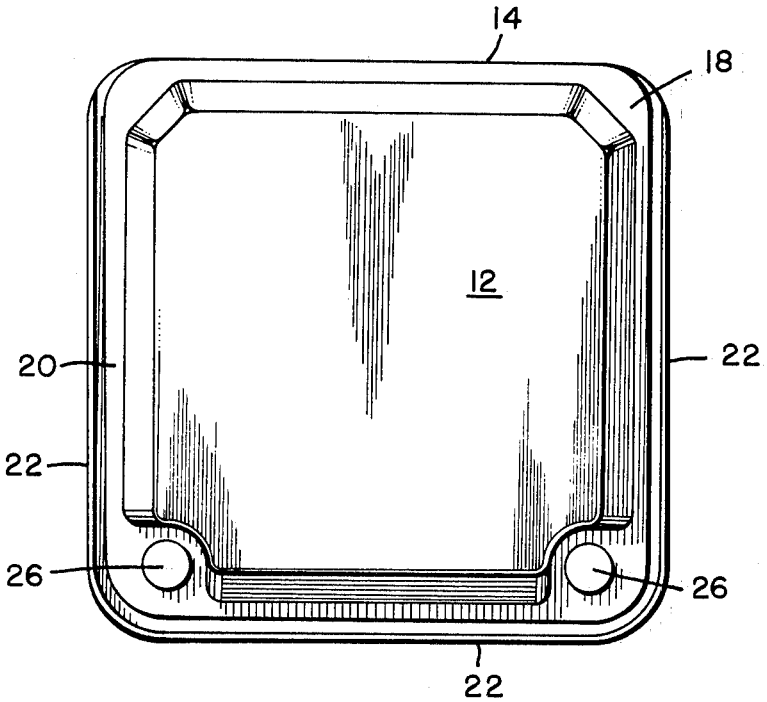
FIG. 2 is a top plan view of the lidded food tray of FIG. 1.
Figure 3:
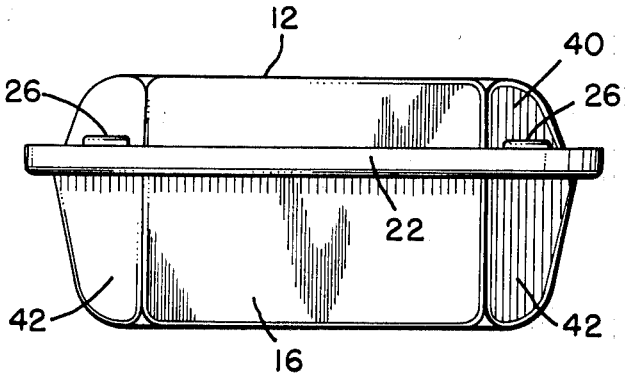
FIG. 3 is a front view in elevation of the lidded food tray of FIG. 2.
Figure 4:
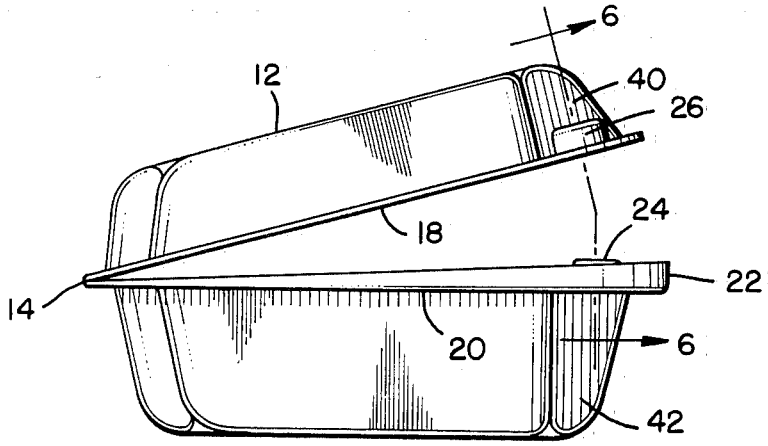
FIG. 4 is a side view in elevation of the lidded food tray of FIG. 3 as seen from the left-hand side of FIG. 3, with the lid partially raised relative to the tray.
Figure 5:
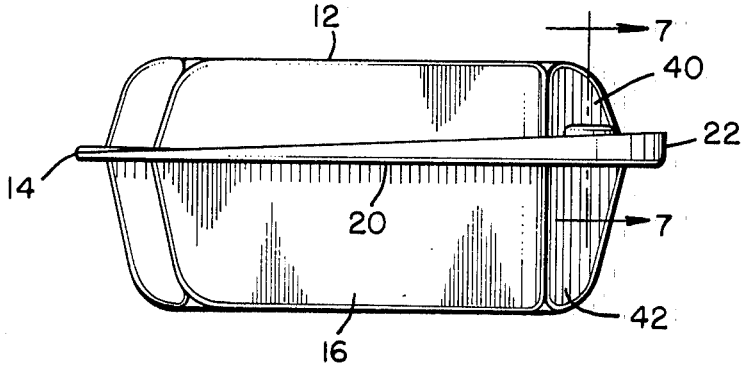
FIG. 5 is a view similar to FIG. 4 with the lid closed.
Figure 6:
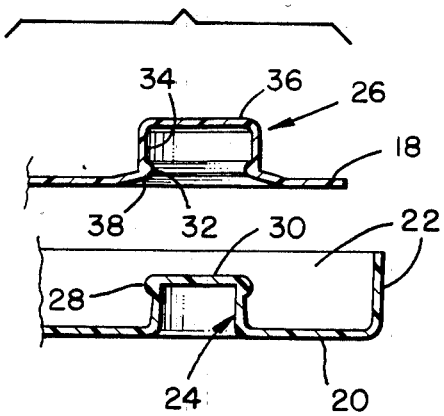
FIG. 6 is a cross-sectional view taken substantially along the plane indicated by line 6—6 of FIG. 4.

Referring now to the drawings in detail, wherein like numerals indicate like elements throughout the several views, the tray 10 of the present invention can be thermoformed by an apparatus and process illustrated and described in U.S. Pat. No. 4,382,762, issued on May 10, 1983 to Schepp. It is preferable that the tray of the present invention be thermoformed from oriented polystyrene, polyvinyl chloride (PVC) or butadiene rubber modified styrene, such as sold under the trademark "K-Resin" by the Phillips Petroleum Company of Bartlesville, Okla. In general, the tray 10 is thermoformed in a mold cavity in one piece having a lid 12 hinged along a line 14 directly to a tray or bottom food holing portion 16.

The lid 12 of tray 10 is provided with a horizontal flange 18 around its periphery adapted to be seated on a horizontal flange 20 provided about the periphery of tray 16. Flange 20 is also provided with an upstanding lip 22, the distance between opposed portions thereof being less than the distance between corresponding portions of horizontal flange 18 on lid 12 so that the lid can be held in place in seated engagement on flange 20 when the lid is in position to close the bottom portion or tray 16.

Formed on opposed corners of the front portion of flange 20 is an upstanding hollow peg or closed cylindrical male element 24. Male elements 24 are adapted to be received in bores or closed female elements 26 formed on corresponding locations on lid flange 18 in snap engagement to securely lock the lid 12 to the bottom portion of the container 10 or tray 16. Each peg 24 is provided with an enlarged diameter head 28 at its upper closed end 30. The enlarged diameter portion 28 of each peg or male element 24 is formed during the molding process because the end 30 first contacts the mold cavity and cools prior to the remaining portion of each peg 24 which flows behind it. Similarly, the bores or female element 26 include an interior annular rim 32 adjacent the entry into each bore since the flowable plastic first cools at this point by contact with the mold cavity. The remaining interior surface of said wall 34 of the female element of bore 26 slightly tapers or flares outwardly from the entrance towards its end 36 by virtue of a "backdraft effect" which is created by the rim 32 cooling first, solidifying, causing the ensuing material flowing into contact with the mold to flow over the rim and underneath it at an angle. Entry to the female element 26 is defined by an annular tapered mouth 38.

Figure 7:
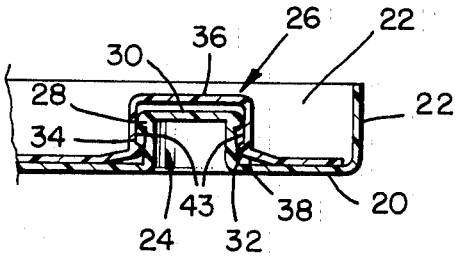
FIG. 7 is a cross-sectional view taken substantially along the plane indicated by line 7—7 of FIG. 5.

When seating the lid 12 on the tray 16, the enlarged head 28 of the peg or male element 24 is guided by tapered mouth 38 towards rim 32 and snapped over and past the rim 32 into the interior of bore 26 into frictional contact with the tapered side wall 34 of bore 26. This action guides the head 28 until top 30 is either firmly seated against the bottom of inwardly facing surface of end 36 of bore 26 in locking engagement or spaced slightly away therefrom as shown in FIG. 7, and provides a space 43 defined by the bottom outer surface of head 28, the side wall 34 and upper surface of rim 32 of bore 26, and the exterior side wall of male element 24. The rim 32 precludes ready separation of the lid 12 from the tray portion 16 of the container 10 without considerable manual force applied in an upward motion to the lid to pivot it about the hinge 14 away from the tray 16.

In order to readily effect the snap engagement between the male element 26 and female element 28, the body portion of the lid 12 and the corresponding body portion of the tray 16 adjacent to the corners of the lid and tray are provided with arcuate surfaces 40 and 42, respectively, for guiding the thumb and forefinger of the hand to effect engagement of the male element within the corresponding female element or bore in the lid by applying pressure between the thumb and forefinger to the top 36 closing each bore or female element 26.

Figure 8:
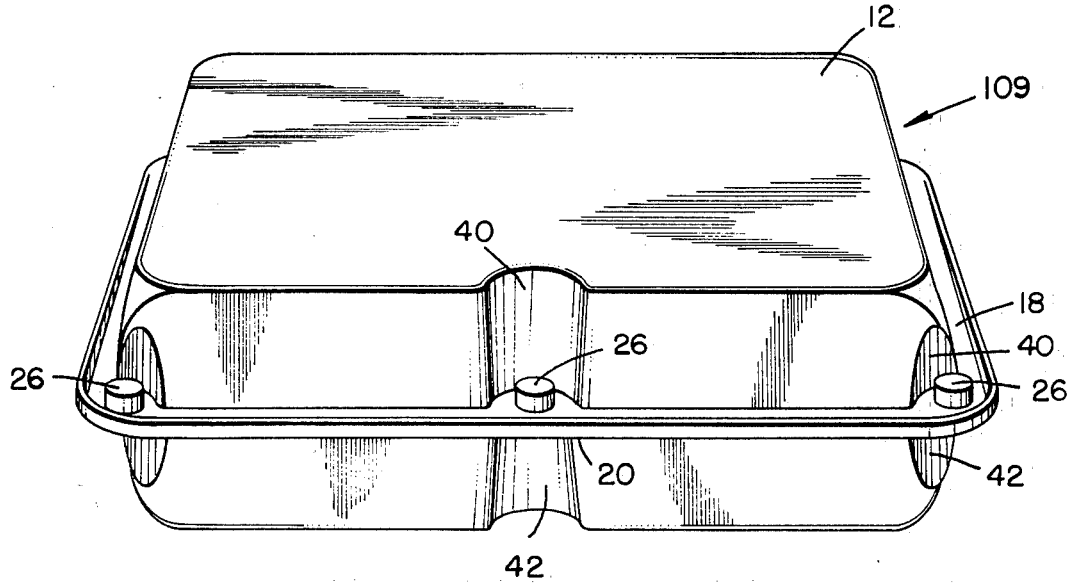
FIG. 8 is a front perspective view of another embodiment of a food tray formed in accordance with the principals of the present invention.

As indicated in FIG. 8, the substantially square food container 10 can be formed in a larger, rectangularly shaped container 10*a* with the locking means 24, 26 at each corner of the front of the flanges 18, 20 of the lid 12 and tray 16, respectively, and with a centrally located locking means 24, 26 in the flange of the lid and tray. As with the corner locking means 24, 26, the central locking means 24, 26 are also provided with arcuate thumb and forefinger guides 40, 42, 52 for pressing the central locking means 24, 26 together. In all other respects, the locking means 24, 26 are identical to those at the corners and as described above.

What is claimed is:

1. A container comprising:

a tray portion, an upper lid portion directly hinged to the rear of said tray portion for movement towards and away from said tray portion to open and close the same, means for locking said lid portion to said tray portion, said locking means including:

a horizontal flange extending around the periphery of said tray portion, a horizontal flange on said lid portion adapted to be seated on the horizontal flange of said tray portion, at least one upright cylindrical male element having a cylindrical side wall, a closed end, and an enlarged diameter portion at said closed end, said male element extending upwardly from the horizontal flange on said tray portion towards the lid portion, and a cylindrical female element having a substantially cylindrical side wall, a closed end, and an annular rim of a slightly smaller diameter than the enlarged diameter portion of said male element extending towards the tray portion from the corresponding position on the horizontal flange extending about the periphery of said lid portion for receiving the enlarged portion of said male element in snap engagement past said annular rim into frictional engagement with said side wall of said female element and providing a space defined by the bottom outer surface of the enlarged diameter portion of the male element, the inner surface of the cylindrical side wall of the female element, the upper surface of the annular rim of the female element and the exterior surface of the cylindrical side wall of the male element.

2. The container of claim 1 wherein the substantially cylindrical side wall of said female element tapers outwardly from the annular rim adjacent the entrance therein towards the closed end of said female element.

3. The container of claim 2 wherein the entrance to said female element includes an annular mouth sloping towards said annular rim to guide said enlarged head of said male element to said rim.

4. The container of claim 3 including an arcuate surface in said lid portion and said tray portion adjacent each mating pair of said male and female elements.

5. The container of claim 4 wherein the flange on said tray portion includes an upstanding wall about its periphery, opposite portions of said wall being spaced a slightly smaller distance than corresponding portions of the flange on said lid portion.

6. The container of claim 5 wherein said lid portion and tray portion are thermoformed from plastic in one integral piece.

7. The container of claim 6 wherein said lid portion and tray portion are substantially square in plan elevation and said male and female elements are located at opposite front corners of said lid and tray portion flanges.

8. The container of claim 6 wherein said lid portion and tray portion are substantially rectangular in plan elevation and said male and female elements are located at opposite front corners and in the center of said lid and tray portion flanges.

* * * * *